US008505989B2

(12) United States Patent
Wells

(10) Patent No.: US 8,505,989 B2
(45) Date of Patent: Aug. 13, 2013

(54) LATCH

(75) Inventor: Adrian Wells, Bargara (AU)

(73) Assignee: Wells Enterprise Australia Pty Ltd (AU)

( * ) Notice: Subject to any disclaimer, the term of this patent is extended or adjusted under 35 U.S.C. 154(b) by 426 days.

(21) Appl. No.: 12/676,724

(22) PCT Filed: Sep. 8, 2008

(86) PCT No.: PCT/AU2008/001332

§ 371 (c)(1),
(2), (4) Date: Jan. 10, 2011

(87) PCT Pub. No.: WO2009/030002

PCT Pub. Date: Mar. 12, 2009

(65) Prior Publication Data

US 2011/0101706 A1 May 5, 2011

(30) Foreign Application Priority Data

Sep. 7, 2007 (AU) ..... 2007904875

(51) Int. Cl.
*E05C 17/56* (2006.01)
*E05C 19/16* (2006.01)

(52) U.S. Cl.
USPC ..... 292/251.5; 292/177; 292/341.15

(58) Field of Classification Search
USPC ..... 292/177–182, 251.5, 341.15–341.17
See application file for complete search history.

(56) References Cited

U.S. PATENT DOCUMENTS

| | | | | | |
|---|---|---|---|---|---|
| 390,507 | A * | 10/1888 | Morton | 292/179 |
| 1,958,940 | A * | 5/1934 | Cavanaugh et al. | 292/144 |
| 2,586,900 | A * | 2/1952 | Alderman | 292/74 |
| 2,727,772 | A * | 12/1955 | Hamilton | 292/144 |
| 3,247,924 | A * | 4/1966 | Price | 180/289 |
| 3,516,701 | A * | 6/1970 | Graham | 292/144 |
| 4,425,771 | A | 1/1984 | Beach et al. | |
| 5,362,116 | A * | 11/1994 | Doyle et al. | 292/144 |
| 6,630,877 | B2 * | 10/2003 | Manthey | 335/205 |
| 7,044,511 | B2 | 5/2006 | Kliefoth et al. | |
| 7,390,035 | B2 * | 6/2008 | Karcz et al. | 292/163 |
| 2005/0184532 | A1 | 8/2005 | Karcz et al. | |
| 2005/0210938 | A1 | 9/2005 | Doyle et al. | |
| 2010/0033279 | A1 * | 2/2010 | Clark | 335/285 |
| 2011/0148126 | A1 * | 6/2011 | Macernis | 292/251.5 |

FOREIGN PATENT DOCUMENTS

| | | | |
|---|---|---|---|
| JP | 03191187 A * | 8/1991 | |
| WO | WO 9203631 A1 * | 3/1992 | |

* cited by examiner

*Primary Examiner* — Carlos Lugo
(74) *Attorney, Agent, or Firm* — Stites & Harbison, PLLC; David W. Nagle, Jr.

(57) ABSTRACT

The invention resides in a latch comprising a lock including a locking pin mounted within a lock body, the locking pin movable between an extended position and a retracted position, the locking pin biased toward the retracted position; and a catch including a release mechanism, the release mechanism for holding the locking pin in the extended position; wherein a magnetic force between the locking pin and the release mechanism holds the locking pin in the extended position which causes the locking pin to engaged the catch.

15 Claims, 9 Drawing Sheets

LATCH

FIELD OF THE INVENTION

This invention relates to a latch. In particular, the latch is used to prevent unwanted opening of a pool gate and therefore will be described in this context. However, it should be appreciated that the latch may be used on types of openings, such as doors and windows.

BACKGROUND OF THE INVENTION

Many home owners install pools in their backyard, especially home owners located in warmer climates. An inherent danger associated with backyard pools is child drowning. Accordingly, many governments throughout the world have legislated that backyard pools must be fenced. This has prevented a large number of child drownings.

Though pool fencing has reduced the number of child drownings, pool fencing has not eliminated child drownings entirely. This is mainly due to children accessing the pool through a pool gate. Pool gate latches have been developed in order to prevent unwanted access to the pool by children. Pool gates latches typically are located out of reach of children.

A very popular and commercially successful pool gate latch is shown in FIG. 2 of U.S. Pat. No. 5,362,116. The pool gate latch operates using a locking pin which is movable between an extended position in which the locking pin engages a catch and a retracted position in which the locking pin is withdrawn from the catch. A magnet forms part of the catch so that when the locking pin is in alignment with the catch, the magnet pulls the locking pin into the catch and hence to the extended position. The magnet ensures that every time the pool gate is closed the locking pin engages the catch.

The latch is typically placed on the inside of a pool gate so that only a person of sufficient height is able to move the locking pin to a retracted position from outside the pool gate, thus allowing the pool gate to be opened. Unfortunately, children are highly adaptable and understand they need to they need to artificially increase their height to enable them to open the latch. Accordingly, children often climb on to the pool gate so they are able to reach over the pool gate to gain access to the locking pin enabling them to open the latch. This can lead to a child drowning.

OBJECT OF THE INVENTION

It is an object of the invention to overcome and/or alleviate one or more of the above disadvantages or provide the consumer with a useful and/or commercial choice.

SUMMARY OF THE INVENTION

In one form, although not necessary the only or broadest form, the invention resides in a latch comprising:

a lock including a locking pin mounted within a lock body, the locking pin movable between an extended position and a retracted position, the locking pin biased toward the retracted position; and a catch including a release mechanism, the release mechanism for holding the locking pin in the extended position;

wherein a magnetic force between the locking pin and the release mechanism holds the locking pin in the extended position which causes the locking pin to engaged the catch.

Normally, the locking pin is made from a magnetic material, such as steel.

The locking pin may be biased to the retracted position via a spring. The spring is typically a helical spring.

The release mechanism typically includes a magnet. The release mechanism may be operated so that the magnetic force changes to move the locking pin from the extended position to the retracted position. Usually the magnet is a permanent magnet. However, it is envisaged that the magnet may be an electro magnet.

The release mechanism may include an actuator that is able to move the release mechanism between a catch position and a release position. The release mechanism may be biased toward the catch position. The release mechanism may be biased toward the catch position via a spring. The spring is typically a helical spring.

A method of operating of a latch including the steps of:

locating a locking pin of a lock adjacent a catch having a release mechanism in a catch position so that the locking pin moves to an extended position to engage the catch via a magnetic force between the locking pin and the release mechanism.

The method may further including the step of:

releasing the locking pin of the lock from the catch by moving the release mechanism to a release position so that the magnetic force between the locking pin and the release mechanism is less than a biasing force applied to the locking pin to move the locking pin to a retracted position The method may also include the step of:

moving the release mechanism to a catch position.

BRIEF DESCRIPTION OF THE DRAWINGS

Embodiments of the invention will be described with reference to the accompany drawings in which.

DETAILED DESCRIPTION OF THE PREFERRED EMBODIMENTS

Figure 1:
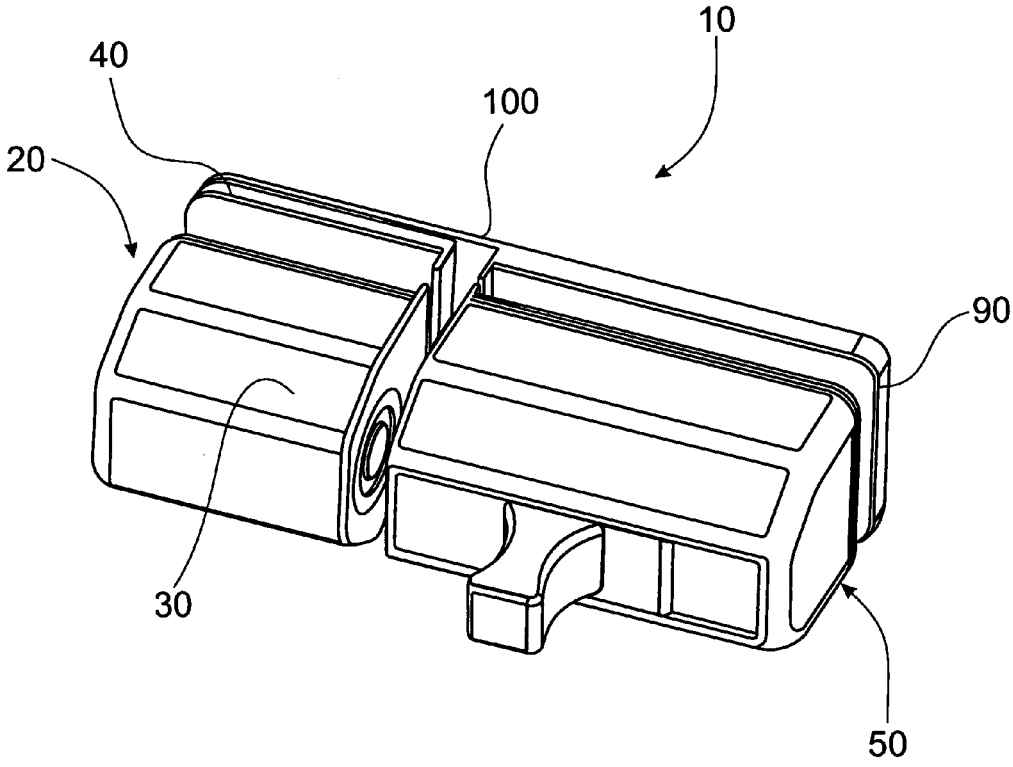
FIG. 1 is a perspective view of a latch according to an embodiment of the invention.

FIG. 1 shows a latch 10 for use on a pool fence gate. Specifically, the latch 10 shown is for use on a glass or polycarbonate pool fence gate. However, it should be appreciated that the latch may be used on a variety of pool fence gates. The latch 10 is made up of a lock 20 and a catch 50.

Figure 2:
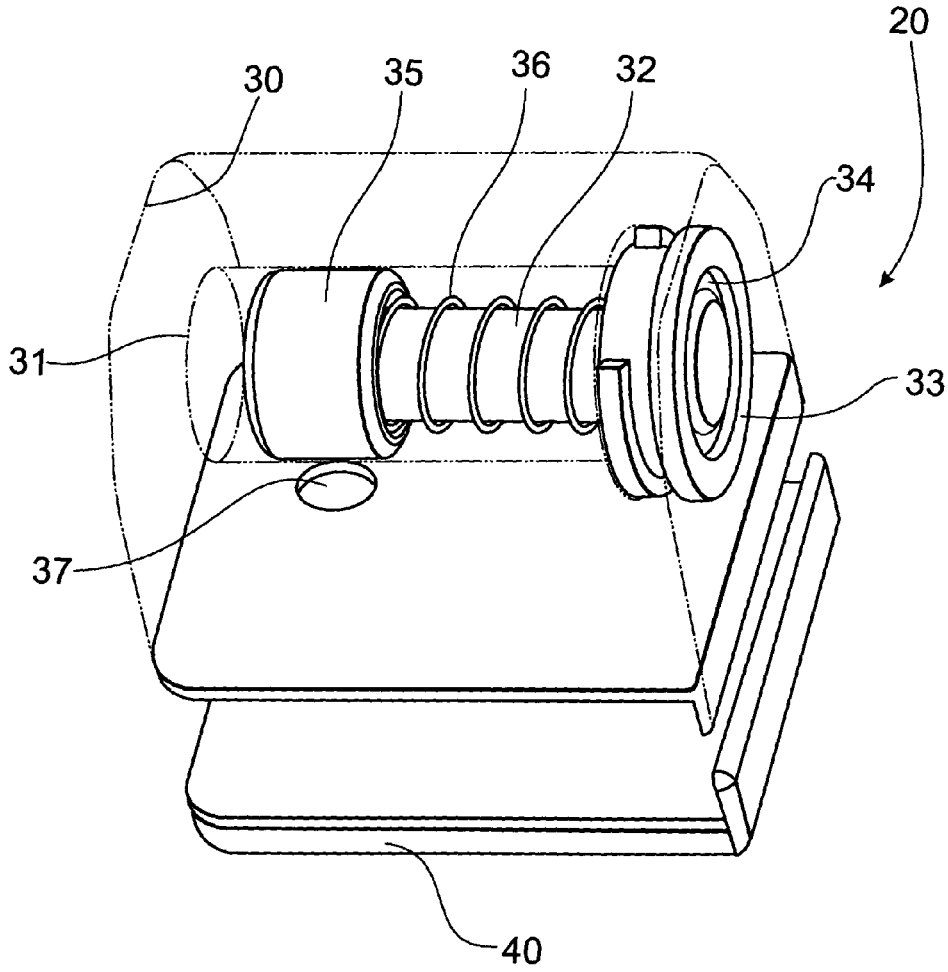
FIG. 2 is a transparent perspective view of a lock shown in FIG. 1.

The lock 20, shown in more detail in FIG. 2, includes a lock body 30 having a lock aperture 31 which extends into the lock body 30. A locking pin 32 is mounted within the lock aperture 31. The locking pin 32 is movable between a retracted position in which the locking pin 32 is positioned within the lock aperture 31 and an extended position in which the locking pin 32 extends outwardly from the lock aperture 31. A lock ring 33 is located adjacent the front of the lock aperture 31. A hole 34 is located within the lock ring 33 to allow the locking pin 32 to pass through the lock ring 33. A pin retainer 35 is located adjacent one end of the locking pin 32. A lock helical spring 36 extends between and is connected to the pin retainer 35 and the lock ring 33. Accordingly, the locking pin 32 is biased by the lock helical spring 36 toward the retraced position.

Figure 6:
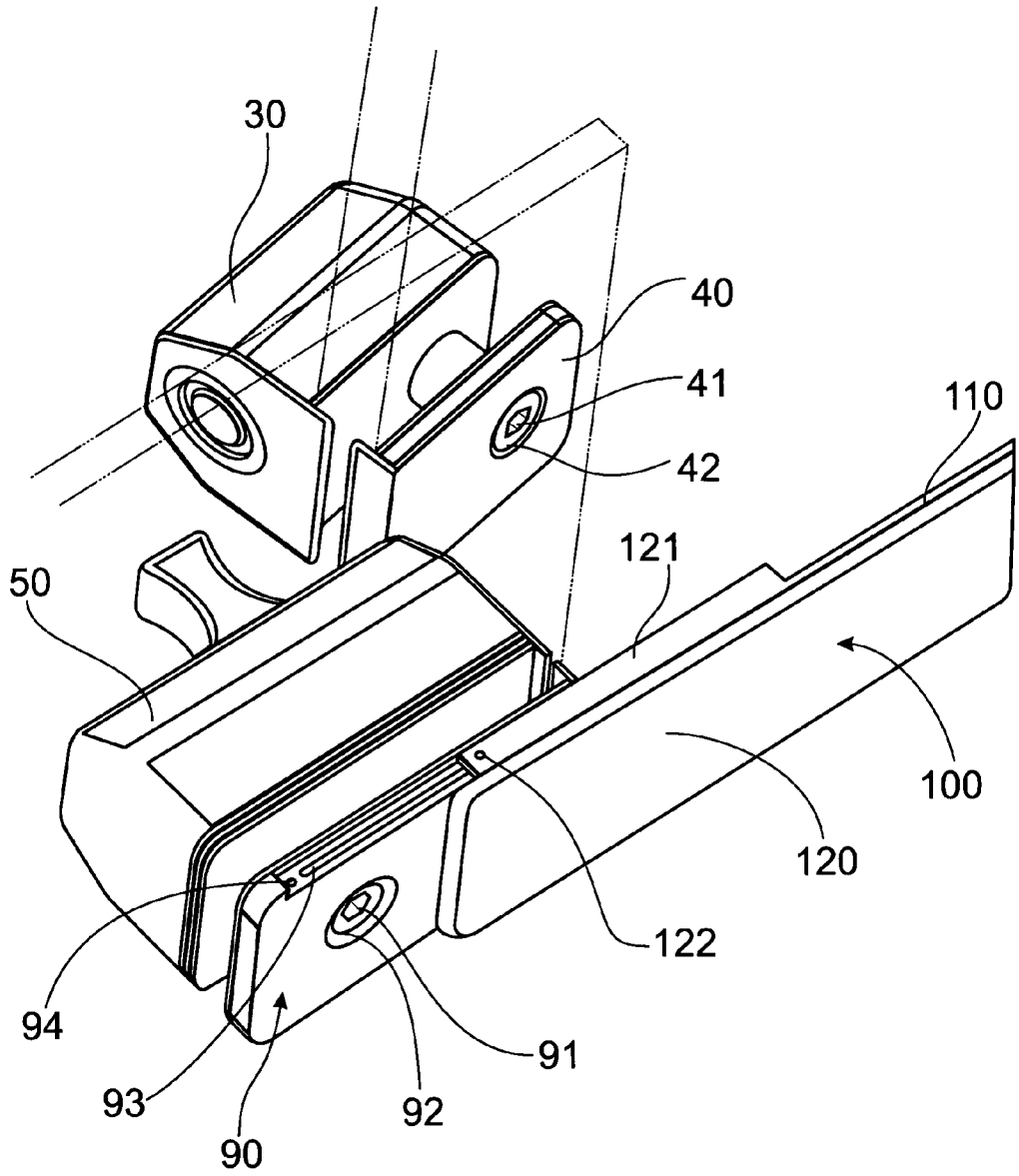
FIG. 6 is a perspective view of the latch of FIG. 1 with catch plate cover partially removed.
Figure 7:
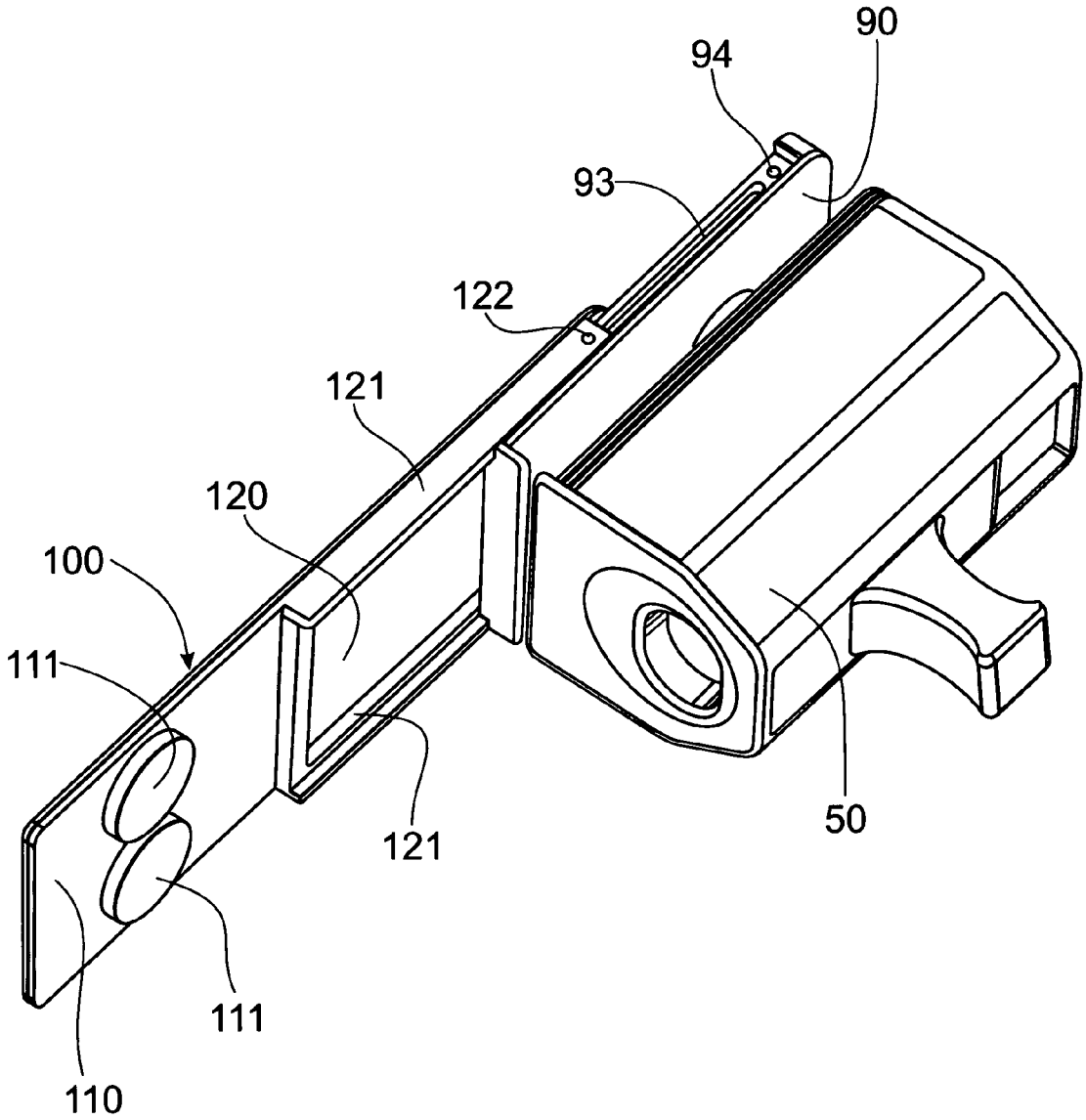
FIG. 7 is a perspective view of the catch of FIG. 1 with catch plate cover partially removed.

The lock 20 also includes a lock plate 40, shown more clearly in FIGS. 6 and 7, which is used to attach the lock body 30 to pool gate panel. The lock plate 40 includes a lock attachment hole 41 through which is placed a locking screw 42. A locking screw hole 37 is located within the lock body 30 to receive to the locking screw 42. In use, a panel hole is drilled through the pool gate panel. The lock plate 40 and the lock body 30 are located on respective sides of the pool gate panel so that the panel hole is in alignment with the lock attachment hole 41 and the locking screw hole 37. The locking screw 42 is placed through the lock attachment hole 41 and the panel hole and screwed into the locking screw hole 37. The locking screw 42 is then tightened until the lock plate 40 and lock body 30 are held firmly on the pool gate panel.

Figure 3:
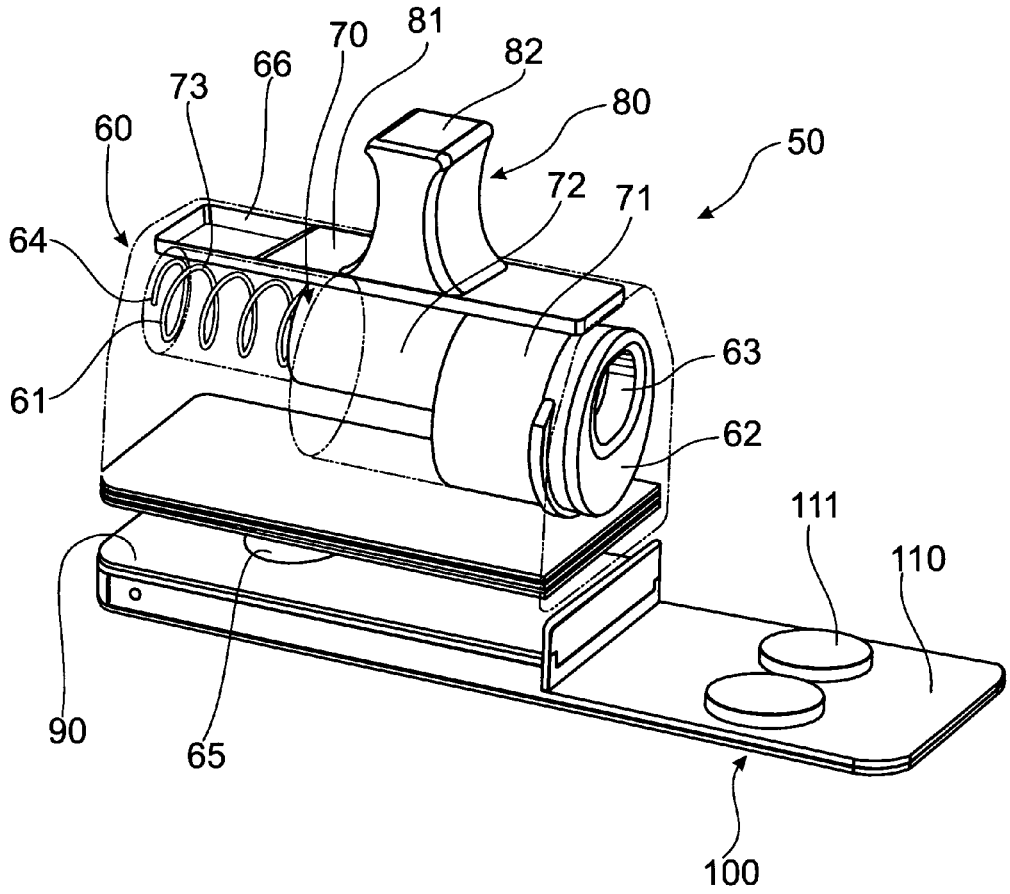
FIG. 3 is a transparent perspective view of a catch shown in FIG. 1.

The catch 50, shown in detail in FIG. 3, includes a catch body 60 having a catch void 61 that extends within the catch body 60. A catch cover 62 is located adjacent one end of the catch void 61. A catch recess 63 is located on a front of the catch cover 62.

A release mechanism 70 is located within the catch void 61 and includes a magnet 71, a connection member 72 and a catch helical spring 73. The magnet 71 is a permanent magnet and is connected to an end of the connection member 72. The catch helical spring 73 is connected to the other end of the connection member 72 and to a spring mount 64 located at one end of the catch void 61. The release mechanism 70 is movable between a release position in which the magnet 71 is moved toward the spring mount 64 and a catch position in which the magnet 71 is moved toward the catch recess 63. The catch helical spring 73 biases the release mechanism 70 toward the catch recess 63.

An actuator 80 is attached to connection member 72 in order to move the release mechanism 70 between the release position and the catch position. The actuator 80 includes a slide 81 and a handle 82. An actuator channel 66 is located on the catch body 60 in which the slide is mounted.

The catch 50 also includes a catch plate 90 which is used to attach the catch body 60 to a pool fence panel and a catch plate cover 100 which is used to cover the catch plate 90. The catch plate 90 and catch plate cover 100 are shown in more detail in FIGS. 6 and 7. The catch plate 90 includes a catch attachment hole 91 through which is placed a catch screw 92. A catch screw hole 65 is located within the catch body 60 to receive the catch screw 92. Two catch plate channels 93 are located on each side of the catch plate 90. Two grub screw holes 94 are located adjacent respective ends of the two catch plate channels 93.

The catch plate cover 100 includes a stop portion 110 and cover portion 120. The stop portion 110 is used to stop the lock 20 and includes two pads 111. The cover portion 120 is used to cover the catch plate 90. The cover portion 120 includes two rails 121 that extend along the length of the cover portion 120. Two grub screw holes 122 are located adjacent the end of the cover portion 120.

In use, a panel hole is drilled through the pool fence panel. The catch plate 90 and the catch body 60 are located on respective sides of the pool gate panel so that the panel hole is in alignment with the catch attachment hole 91 and the catch screw hole 65. The catch screw 92 is placed through the catch attachment hole 91 and the panel hole and screwed into the catch screw hole 65. The catch screw 92 is then tightened until the catch plate 90 and catch body 60 are held firmly on the pool fence panel.

Once the catch body 60 and catch plate 90 are fixed to the pool fence panel, the catch plate cover 100 is attached to the catch plate 90. The catch plate cover 100 is attached to the catch plate 90 by aligning the two rails 121 of the cover portion 120 of the catch plate cover 100 with the plate channels 93 in the catch plate 90. The two rails 121 slide into the respective plate channels 93 until the cover portion 120 entirely covers the cover plate 100. Grubs screws (not shown) are then placed through the grub screw holes 94 and 122 to hold the catch plate cover 100 to the catch plate 90.

Figure 4:
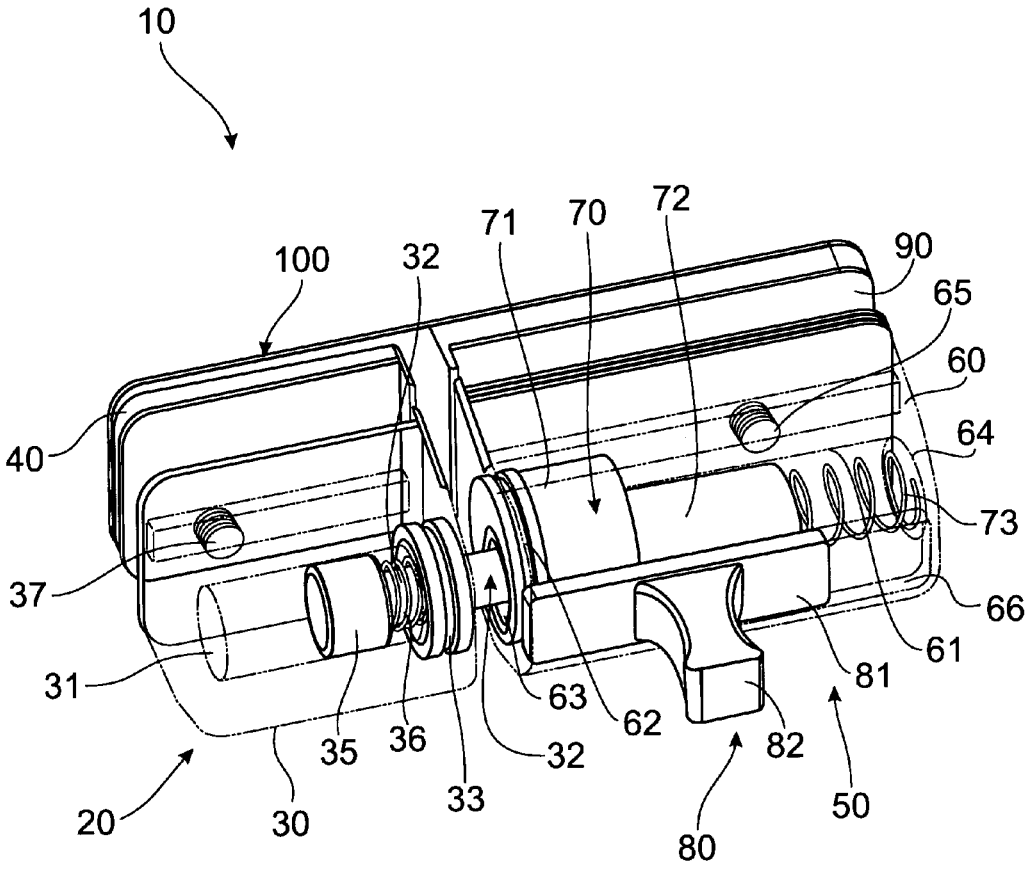
FIG. 4 is a transparent perspective view of a latch shown in FIG. 1.

In use, the lock 20 is typically mounted to a hinged pool gate whilst the catch 50 is mounted to a fixed pool fence. When the hinged pool gate is closed, this causes the lock 20 and the catch 50 to be located adjacent each other, as shown in FIG. 4. This causes the magnet 71, located within the catch void 61, to attract the locking pin 32 via magnetic force and cause the locking pin 32 to be moved to the extended position. The locking pin 32, when in the extended position, moves into the catch recess 63 to prevent movement of the hinged pool gate with respect to the fixed pool fence.

Figure 5:
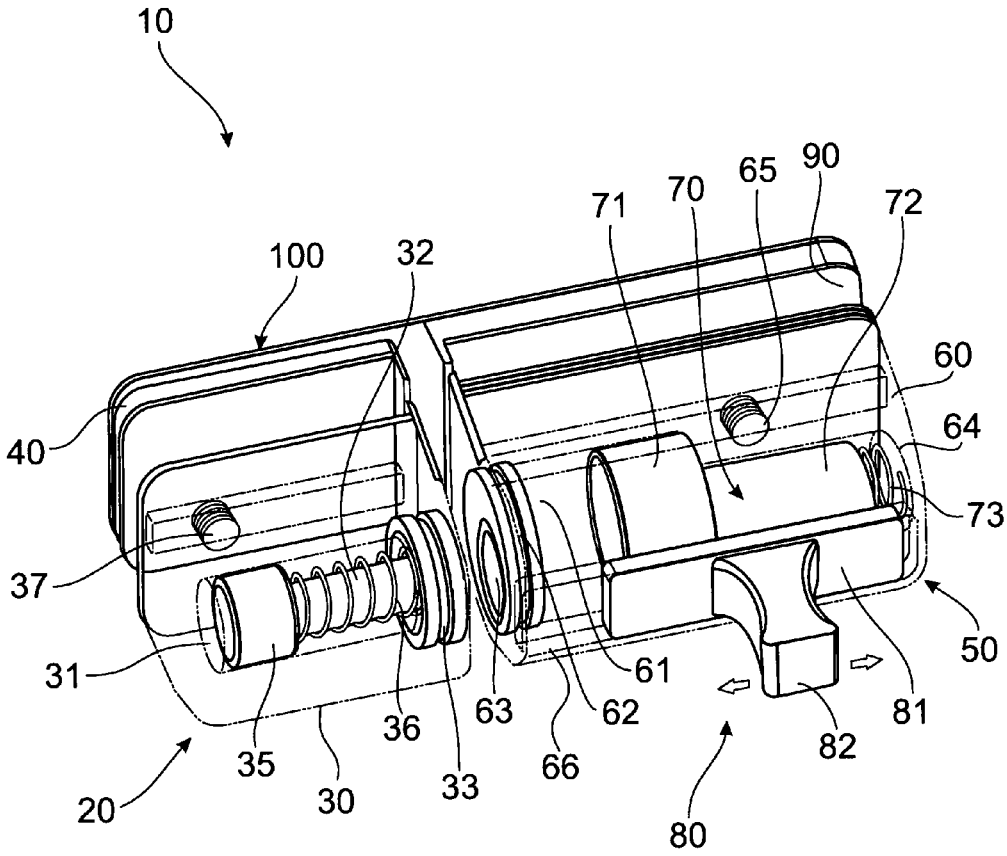
FIG. 5 is a further transparent perspective view of a latch shown in FIG. 1.

In order to release the locking pin 32 from the catch recess 63 and hence be able to open the hinged pool gate, the actuator 80 is slid along the actuator channel 65 which causes release mechanism 70 to be moved to the release position, as shown in FIG. 5. At the release position, the magnetic force applied to the locking pin 32 by the magnet 71 is less than the spring force applied by the lock helical spring 36 to the locking pin 32 causing the locking pin 32 to be moved to the retracted position. The pool gate is thus able to be opened.

When the actuator 80 is released, the catch helical spring 73 of the release mechanism 70 causes the release mechanism 70 to be moved to the catch position. The lock helical spring 36 of the lock 20 holds the locking pin 32 in the retracted position until the locking pin 32 is again aligned with the magnet 71 of the catch 50 at which point the magnetic force of the magnet will be stronger than the spring force provided by the lock helical spring 36 and the locking pin 32 will again move to the extended position.

One of the advantages of the above latch 10 is that when any lateral force is applied to the latch 10 when the locking pin 32 is in the extended position and thereby engaging the catch recess 63, is that the locking pin 32 is unable to move to the retracted position even when the release mechanism 70 is moved to the release position. That is, a small amount of lateral force keeps the locking pin 32 locked to the catch recess 63. Hence, the pool gate will be unable to be opened when a lateral force is being applied to the latch 10. This prevents the unwanted opening of a pool gate by a person who climbs on the gate, and thereby applies a lateral force to the pool gate, even though the actuator 80 is able to be slid and cause the release mechanism to move to the release position. This is due to no physical connection being required between the actuator 80 and the locking pin 32 as shown in prior art pool gate latches.

Figure 8:
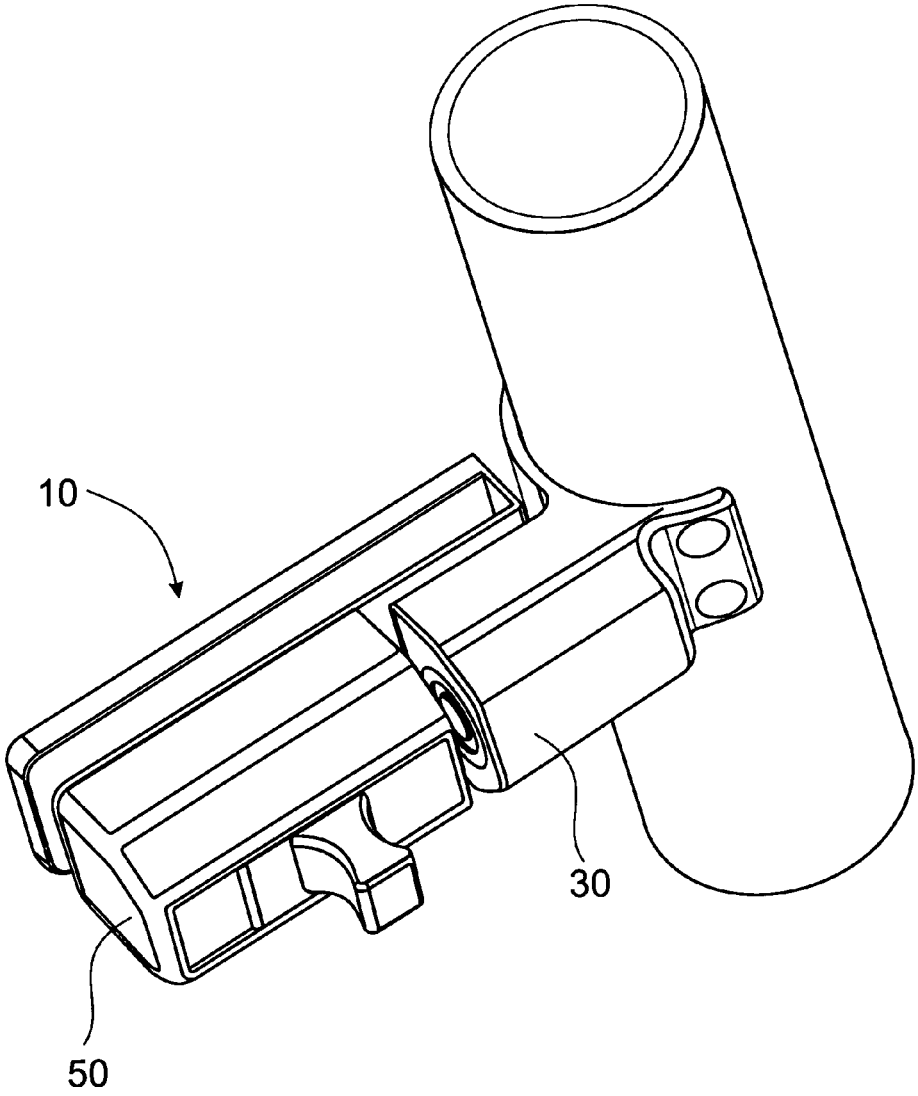
FIG. 8 is a perspective view of a latch according to a further embodiment of the invention.
Figure 9:
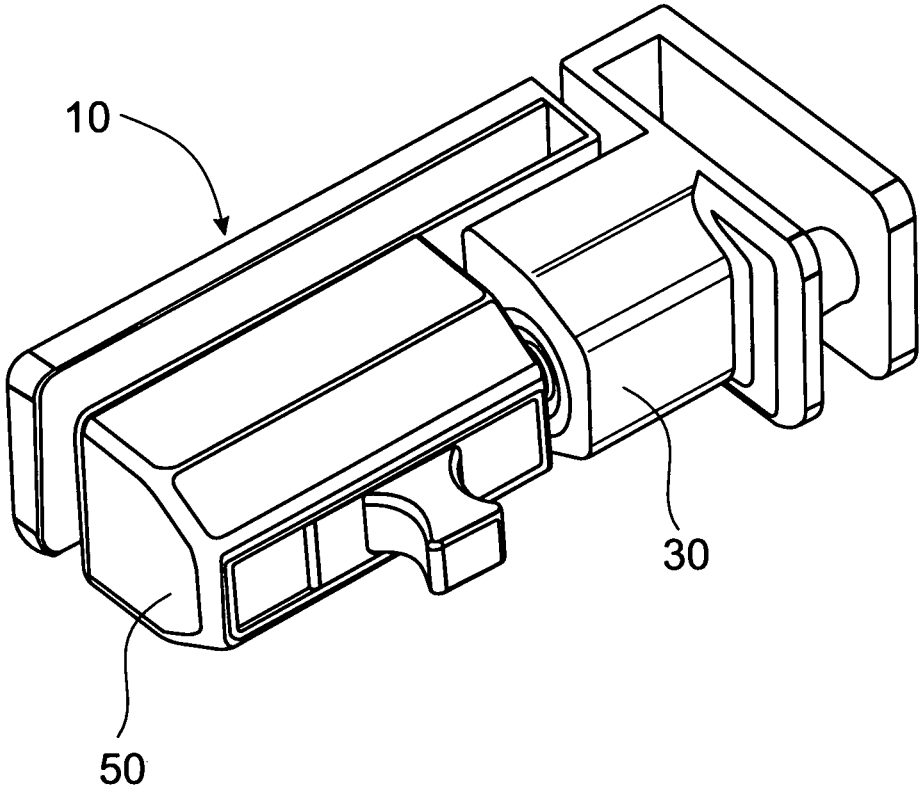
FIG. 9 is a perspective view of a latch according to another further embodiment of the invention.

It should be appreciated that the manner in which the catch body 60 and the lock body 30 is attached to a pool fence and pool gate may be modified as shown in FIGS. 8 and 9.

It should be appreciated various other changes and modifications may be made to the embodiment described without departing from the spirit or scope of the invention.

The invention claimed is:

1. A latch comprising:

a lock including a locking pin mounted within a lock body, the locking pin movable between an extended position and a retracted position, the locking pin biased toward the refracted position;

a catch including a release mechanism, the release mechanism for holding the locking pin in the extended position; and a magnet located to provide a magnetic force between the locking pin and the release mechanism; wherein the magnetic force between the locking pin and the release mechanism holds the locking pin in the extended position which causes the locking pin to engage the catch, and the locking pin is released from the catch by moving the release mechanism to a release position so that the magnetic force between the locking pin and the release mechanism is less than the biasing force applied to the locking pin to move the locking pin to the retracted position; and wherein the locking pin and the release mechanism are longitudinally aligned.

2. The latch of claim 1, wherein the release mechanism includes the magnet.

3. The latch of claim 2, wherein the magnet of the release mechanism is a permanent magnet.

4. The latch of claim 1, wherein the release mechanism includes an actuator that is able to move the release mechanism between a catch position and the release position.

5. The latch of claim 4, wherein the release mechanism may be biased toward the catch position.

6. The latch of claim 5, wherein the release mechanism is biased toward the catch position via a spring.

7. The latch of claim 6, wherein the spring is a helical spring.

8. The latch of claim 4, wherein the actuator includes a slide and a handle.

9. The latch of claim 1, wherein the catch includes a catch recess to catch the locking pin.

10. The latch of claim 9, wherein the locking pin is biased toward the retracted position via a spring.

11. The latch of claim 10, wherein the spring is a helical spring.

12. The latch of claim 1, wherein the locking pin of the lock includes the magnet.

13. The latch of claim 1, wherein the release mechanism is operated so that the magnetic force between the release mechanism and the locking pin changes to move the locking pin from the extended position to the retracted position.

14. A method of operating a latch including the steps of:

locating a locking pin of a lock to be longitudinally aligned with a catch having a release mechanism in a catch position, and locating a magnet to provide a magnetic force between the locking pin and the release mechanism, so that the locking pin moves to an extended position to engage the catch via the magnetic force between the locking pin and the release mechanism; and releasing the locking pin from the catch by moving the release mechanism to a release position so that the magnetic force between the locking pin and the release mechanism is less than a biasing force applied to the locking pin to move the locking pin to a retracted position.

15. The method of claim 14, further including the step of: moving the release mechanism to a catch position.

* * * * *